US006167210A

United States Patent [19]

Maess et al.

[11] Patent Number: 6,167,210

[45] Date of Patent: Dec. 26, 2000

[54] METHOD AND APPARATUS FOR OPTIMIZING A CHARGE IMAGE ON A PHOTOCONDUCTOR OF A COPIER OR PRINTER

[75] Inventors: Volkhard Maess, Erding; Martin Schleusener, Zorneding, both of Germany

[73] Assignee: Océ Printing Systems GmbH, Poing, Germany

[21] Appl. No.: 09/155,451

[22] PCT Filed: Mar. 27, 1997

[86] PCT No.: PCT/DE97/00663

§ 371 Date: Sep. 29, 1998

§ 102(e) Date: Sep. 29, 1998

[87] PCT Pub. No.: WO97/37285

PCT Pub. Date: Oct. 9, 1997

[30] Foreign Application Priority Data

Mar. 29, 1996 [DE] Germany ..... 196 12 637

[51] Int. Cl.[7] ..... G03G 15/02

[52] U.S. Cl. ..... 399/50; 399/46; 399/51

[58] Field of Search ..... 399/50–51, 94, 399/127, 128, 44, 46; 361/225

[56] References Cited

U.S. PATENT DOCUMENTS

| | | | |
|---|---|---|---|
| 4,502,777 | 3/1985 | Okamoto et al. | 399/46 |
| 4,508,446 | 4/1985 | Imai . | |
| 4,592,646 | 6/1986 | Suzuki et al. . | |
| 4,855,766 | 8/1989 | Suzuki . | |
| 5,019,862 | 5/1991 | Nakamura et al. | 399/46 |
| 5,749,022 | 5/1998 | Kikui et al. | 399/50 |
| 6,034,703 | 3/2000 | Broddin et al. | 399/46 X |

FOREIGN PATENT DOCUMENTS

| | | |
|---|---|---|
| 0 370 482 | 5/1990 | European Pat. Off. . |
| 2 082 349 | 3/1982 | United Kingdom . |

*Primary Examiner*—Quana M. Grainger
*Attorney, Agent, or Firm*—Schiff Hardin & Waite

[57] ABSTRACT

A printer or copier has a photoconductor on which charge patterns are formed that are in turn inked and printed onto a recording medium. An optimized exposure energy is determined for a given potential of the photoconductor by calculating a sensitivity factor. The optimized charge potential may also be calculated on the basis of the sensitivity factor for a given exposure energy.

20 Claims, 4 Drawing Sheets

METHOD AND APPARATUS FOR OPTIMIZING A CHARGE IMAGE ON A PHOTOCONDUCTOR OF A COPIER OR PRINTER

BACKGROUND OF THE INVENTION

1. Field of the Invention

The present invention is directed to a method for optimizing a charge image generation of a photoconductor of electrophotographic printer and copier devices.

2. Description of the Related Art

Compared to the copying results that can be achieved with electrophotographic copier devices, the user of such devices makes considerably higher quality demands of the printing results that can be achieved with electrographic printer devices. Users of copier devices therefore also accept copying results that are somewhat poorer compared to the original of the copy.

Since electrophotographic printer devices, however, are usually employed in conjunction with EDP (electronic data processing) systems and the possibilities for the user to influence the print quality are slight in this respect, extremely high quality demands exist in the case of electrophotographic printer devices. In order to do justice to these high demands, it is necessary to reduce the allowable tolerance ranges in electrophotographic processes.

Electrophotographic printer device print, for example, single sheets or continuous stock in that a latent image is generated on a photoconductor that preferably has the form of a drum. To this end, the photoconductor is charged to a defined charging potential. Subsequently, a latent image is generated on the photoconductor with an illumination means that supplies energy to the photoconductor in punctiform fashion, the latent image being generated in that the charge in the regions of the photoconductor is reduced to such an extent by illumination that these regions remains white in the subsequent printout in what is referred to as "charged area development" (CAD) or, respectively, are inked with toner in what is referred to as "discharged area development" (DAD). Following the exposure, toner is applied to the photoconductor with the assistance of a development means, the toner remaining adhering to the charged regions (CAD process) or, respectively, to the discharged regions (DAD process) of the photoconductor.

The toner image on the photoconductor is subsequently transferred onto, for example, paper or some other recording medium and is fused into the recording medium by heating in a following fixing station or connected thereto by adhesion forces arises when the toner image melts. After the toner image has been transferred onto the recording medium, the photoconductor is completely discharged and cleaned of residual toner in order to be subsequently completely charged again to a defined potential as preparation for the next exposure.

As FIG. 1 shows, the potential of the photoconductor upon illumination thereof decreases from a charging potential V2, to which the photoconductor was charge before the illumination and that can be kept constant with a charge regulation, to a substantially lower potential VD1 or, respectively, VD2 along a characteristic K1 or, respectively, K2. The potential of illuminated regions is dependent, on the one hand, on the height of the illumination energy, the duration of the illumination and the height of the charging potential V2.

On the other hand, the discharge characteristic K1, K2 and, thus, the height of the potential of exposed regions on the photoconductor is also influenced, for example, by manufacture-conditioned fluctuations, the quality of the photoconductor, its age, its temperature and is also influenced by the current process status just as, for example, the start of a printing process, longer pauses between individual printing processes or by a variety of environmental influences. Fluctuations in potential VD1, VD2 of the illuminated regions of the photoconductor derive therefrom that, due to the different toner acceptance in the development unit caused as a result thereof, lead to quality fluctuations of a print image to be produced.

For compensating temperature fluctuations, it is known to keep the photoconductor at a constant temperature during the entire operation. In part, the photoconductor is even kept at a constant temperature uninterrupted. What is thereby disadvantageous is that a corresponding heating must be provided, this causing increased energy costs. Moreover, only one of the aforementioned influencing factors is influenced by the heating.

It is also known to vary the toner concentration dependent on certain parameters for compensating quality fluctuations. However, all quality fluctuations cannot be compensated therewith. In particular, raster or fine-line reproductions cannot be kept constant in the same way by varying the toner concentration.

The Japanese Patent document JP 6-230642 (A) or, respectively, the appertaining Japanese Patent Application HEI sei 5-15327 discloses a method wherein, for optimizing the charge image generation, the discharge characteristic of the photoconductor is determined dependent on the illumination energy by repeated measurement of the discharge potential at different illumination energies and a subsequent approximation between the measured values. It is disadvantageous that both a plurality of measurements are required and that an approximation must also be subsequently made in order to determine the optimum value for the illumination energy.

U.S. Pat. No. 4,855,766 explains a method for determining an optimum charging potential and an optimum illumination energy, whereby the charging potential or, respectively, the illumination energy is incremented step-by-step by a predetermined amount until a rated value is reached. In this method, thus, a plurality of iteration steps are to be implemented as a rule until the rated value for the difference of the discharge potential and the charging potential or, respectively, the rated value for the rise of the discharge curve of the photoconductor given an optimum illumination energy is reached.

German Published Application 27 41 713 discloses a method for the stabilization of a charge image wherein, given a predetermined illumination energy, the optimum charging potential can in fact be determined with one or two iteration steps but coefficients of functions must be previously determined that were derived from a model of the photoconductor and, accordingly, take a plurality of influencing quantities into consideration. As a result thereof, however, the equations become very complex and the calculating time for the calculation of the coefficients rises. Ultimately, six value groups of the charging potential and of the discharge potential must be measured until the sought coefficients can then be determined by solving an equation system. However, the coefficients can then still have great errors. Alternatively, the registration of a plurality of measured values is respectively proposed for the determination of one of the coefficients, from which the sought coefficients are then determined with the required precision with the methods known from linear optimization.

U.S. Pat. No. 4,502,777 discloses a plurality of physical relationships in a copying process and, building thereon, discloses a comparatively complicated method for the correction of the charging voltage or, respectively, of the current flowing through the charging unit that is implemented without measuring the charging potential or the discharge potential. When explaining the physical relationships, an iteration method for determining the charging potential or, respectively, the current flowing through the charging device given a constant illumination energy is also recited. In addition to the iteration steps to be multiply implemented, however, this iteration method has the disadvantage that it assumes an approximately linear relationship between discharge potential and illumination energy.

SUMMARY OF THE INVENTION

An object of the present invention is to provide a simple method for optimizing a charge image generation on a photoconductor of electrophotographic printer and copier devices, whereby the quality of print images is independent of quality and temperature fluctuations of the photoconductor as well as independent of changes in process status and a variation of the characteristics of the photoconductor resulting therefrom.

In a method for optimizing a charge image generation on a photoconductor of electrophotographic printer and copier devices, this is inventively achieved by the steps of:

a) the photoconductor is charged (step 1*a*) to a predetermined charging potential;

b) the charged photoconductor is illuminated (step 1*b*) with a predetermined illumination energy and is thereby discharged;

c) the discharge potential of the illuminated photoconductor is determined (step 1*c*);

d) the temperature of the photoconductor is determined (step 2);

e) a sensitivity factor is determined from the charging potential, the illumination energy, the discharge potential and the temperature, said sensitivity factor defining the relationship between the discharge potential and the illumination energy in a predetermined relationship between the discharge potential and the illumination energy given a fixed temperature (step 3);

f) a new illumination energy that is employed instead of the previous illumination energy is determined from the charging potential, the temperature, the identified sensitivity factor and a predetermined rated value for the discharge potential according to the given relationship converted to the illumination energy (step 4);

g) and whereby a charge image is generated (step 7) with the determined illumination energy and the predetermined charging potential.

Alternately, the method provides the steps of:

A) the photoconductor is charged (step 8*a*) to a predetermined charging potential;

B) the charged photoconductor is illuminated (step 8*b*"; 8*b*"') with a predetermined illumination energy and is thereby discharged;

C) the discharge potential of the illuminated photoconductor is determined (step 8*c*);

D) the temperature of the photoconductor is determined (step 2);

E) a sensitivity factor is determined from the charging potential, the illumination energy, the discharge potential and the temperature, said sensitivity factor defining the relationship between the discharge potential and the illumination energy in a predetermined relationship between the discharge potential and the illumination energy given a fixed temperature(step 9; 9');

F) a new charging potential that is employed instead of the previous charging potential is determined from the illumination energy, the temperature, the identified sensitivity factor and a predetermined rated value for the discharge potential according to the given relationship converted to the charging potential (step 10; 10');

H) and whereby a charge image is generated (step 13; 13') with the predetermined illumination energy and the determined charging potential. Advantageous developments are provided by further features, such as the sensitivity factor being determined according to the equation $$K = \frac{1}{TF \cdot H} \cdot \ln\left(\frac{V_c - V_{lim}}{V_D - V_{lim}}\right)$$

whereby

K is the sensitivity factor,

TF is a temperature factor determined from the temperature T,

H is the illumination energy in $\mu$Ws/cm$^2$, $V_C$ is the charging potential in V, $V_D$ is the discharge potential in V, and $V_{lim}$ is the lowest obtainable discharge potential in V.

As a further feature, the new illumination energy is determined according to the equation:

$$H = \frac{1}{T \cdot K} \cdot \ln\left(\frac{V_C^s - V_{lim}}{V_D^{soll} - V_{lim}}\right)$$

whereby

H is the illumination energy,

TF is a temperature factor determined from the temperature,

K is the sensitivity factor, $V_C$ is the charging potential in V, $V_D^{soll}$ is the rated value of the discharge potential in V, and $V_{lim}$ is the lowest obtainable discharge potential in V.

Preferably, the following steps are implemented following step f) according to above listed method:

f1) after the renewed illumination of the photoconductor charged with the predetermined charging potential with the most recently determined illumination energy, the discharge potential on the photoconductor is identified anew and employed instead of the previous discharge potential (steps 5*a*, 5*b*', 5*c*);

f2) when the discharge potential lies within a predetermined tolerance range, the step g) above is implemented (step 6);

f3) when the discharge potential does not lie within the tolerance range, the steps d) through f3) or e) through f3) are repeated until the discharge potential lies within the tolerance range (step 6).

In one embodiment, a rated value for the difference of the charging potential and the discharge potential is employed instead of the rated value.

According to the alternate embodiment of the main method, the sensitivity factor is determined according to the equation:

$$K = \frac{1}{TF \cdot H} \cdot \ln\left(\frac{V_c - V_{lim}}{V_D - V_{lim}}\right)$$

whereby

K is the sensitivity factor,

TF is a temperature factor determined from the temperature T,

H is the illumination energy in $\mu$Ws/cm$^2$, $V_C$ is the charging potential in V, $V_D$ is the discharge potential in V, and $V_{lim}$ is the lowest obtainable discharge potential in V.

The new charging potential is determined according to the equation:

$$V_C=(V_D^{soll}-V_{lim})\cdot exp(K\cdot TF\cdot H)+V_{lim}$$

whereby $V_C$ is the charging potential, $V_D^{soll}$ is the discharge potential in V, $V_{lim}$ is the lowest obtainable discharge voltage in V;

TF is a temperature factor determined from the temperature T,

K is the sensitivity factor, and

H is the illumination energy in $\mu$Ws/cm$^2$.

Preferably, a rated value for the difference of the charging potential and the discharge potential is employed instead of the rated value.

The following steps are implemented following the step F):

F1) after the renewed illumination of the photoconductor charged with the determined charging potential with the predetermined illumination energy, the discharge potential on the photoconductor is identified anew and employed instead of the previous discharge potential (steps 11*a*, 11*b*', 11*c*; 11*a*', 11*b*', 11*c*);

F2) when the discharge potential lies within a predetermined tolerance range, the step G) according to the second main embodiment is implemented (step 12);

f3) when the discharge potential does not lie within the tolerance range, the steps D) through F3) or E) through F3) are repeated until the discharge potential lies within the tolerance range (step 12).

Before the implementation of the step F1), a check is carried out to see whether the determined charging potential lies in a predetermined working range (step 10); the step F1) is only implemented when the determined charging potential lies within the working range; and in that, instead of the steps F1 through F3), a charge image is generated with the predetermined illumination energy and with a predetermined charging potential that preferably lies at a limit of the working range when the identified charging potential lies outside the working range (step 14; 14').

Before the implementation of said steps, a determination is made that an illumination energy determined for a prescribed charging potential lies above a maximum illumination energy; and in that the prescribed illumination energy has the value of the maximum illumination energy.

Before the implementation of said steps, a determination is made that an illumination energy determined for a prescribed charging potential lies below a minimum illumination energy(steps 4, 4'); and in that the prescribed illumination energy has the value of the minimum illumination energy.

The charging potential is determined according to the equation:

$$\Delta V_c = \frac{V_D - V_{lim}}{1 - \exp(-K \cdot TF \cdot H^{\max})} + V_{lim}$$

whereby $V_C$ is the charging potential in V, $V_D$ is the discharge potential in V, K is the sensitivity factor, TF is a temperature factor determined from the temperature T, H is the illumination energy in $\mu$Ws/cm$^2$, and $V_{lim}$ is the lowest obtainable discharge potential in V.

A temperature factor is determined from the temperature according to the following equation:

$$TF=a+b\cdot T+c\cdot T^2,$$

whereby T is the temperature in degrees Celsius, and whereby a, b and c are fixed coefficients.

For accelerating the implementation of the method, allocation tables are produced proceeding from the predetermined relationship and/or the converted relationship.

For accelerating the implementation of the method, allocation tables are empirically produced printer-specific.

The method may be implemented after turn-on, after printing pauses, after replacement of the photoconductor and/or at predetermined time intervals during printing operation.

According to the inventive method, a residual or, respectively, discharge potential present on a photoconductor after an illumination thereof is set to a predetermined rated value from which slight deviations only within narrow limits are allowed.

In order to achieve a discharge potential that lies within the tolerance range defined around the given rated value, a charging potential that is the potential to which the photoconductor is charged before the illumination and/or an illumination energy employed for the illumination of the photoconductor is, for example, adapted. Such an adaptation of the charging potential and/or of the illumination energy can be achieved, for example, upon employment of allocation tables. Dependent, for example, on various parameters, the allocation tables contain corresponding values to which the charging potential and/or the illumination energy are set.

The parameters employed are, for example, the temperature of the photoconductor, the discharge potential remaining after a test illumination and a calculated or determined sensitivity factor of the photoconductor layer.

The charging potential and/or the illumination energy to be employed for achieving optimum printing results are thus calculated or, preferably given the assistance of one or more defined parameters, are taken from the allocation table. The tables contain, for example, empirically determined values or values calculated with equations.

In the method for optimizing a charge image generation on a photoconductor in electrophotographic printer and copier devices, the photoconductor is charged to a standard charging potential. Subsequently, a discharge potential generated on the photoconductor after the exposure with standard illumination energy and the temperature of the photoconductor is measured. Following thereupon, for example with a microprocessor, a sensitivity factor and an illumination energy adapted on the basis of the sensitivity factor are determined.

In a development of the method according to the invention, a check is carried out to see whether the determined illumination energy lies between an maximally and minimally allowed illumination energy. When this is the case, then the photoconductor is charged anew to the predetermined charging potential, is illuminated with the identified, adapted discharge energy, and the generated discharge potential is subsequently measured or, respectively, identified. When the generated discharge potential lies in the region of the predetermined rated value, the charge image is generated on the photoconductor charged with the standard charging potential in that this is illuminated with the adapted illumination energy.

When the generated discharge potential deviates too far from the given rated value, the temperature of the photoconductor is determined anew, a new sensitivity and a new, adapted illumination energy is formed and the subsequent check process with respect to the generated discharge potential is repeated. An iteration loop thereby formed is traversed until the discharge potential generated on the photoconductor after the illumination lies in the prescribed tolerance range, i.e. in the region of the given rated value, and a charge image can be generated.

Instead of determining a tolerance range with the assistance of a prescribable rated value, this can also be determined by a prescribed difference value, whereby the difference value is calculated from the charging potential and the generated discharge potential. The distance between charged and discharged regions thus remains constant, apart from slight fluctuations.

When, however, the calculated, adapted illumination energy exceeds the prescribed maximum limit value, which is usually determined by the structure of the printer, then the method steps recited in patent claim 6 are preferably implemented.

A discharge potential is generated with a maximum illumination energy and the prescribed charging potential and is measured. An adapted charging potential is subsequently determined from the measure discharge potential, the photoconductor being charged therewith insofar as the adapted charging potential lies within a prescribed working range that is likewise generally established by the technology utilized.

In one development, the photoconductor charged to the identified charging potential is again illuminated with the maximum illumination energy and the newly generated discharge potential is determined. When this lies in the prescribed tolerance range, then the charge image is generated on the photoconductor with the adapted charging potential and the maximum illumination energy.

When, however, the generated discharge potential does not lie in the predetermined tolerance range, the adapted charging potential is re-determined and the above-explained steps are repeated in an iteration loop until the value of the generated discharge potential lies in the prescribed tolerance range.

When, following a prescribed plurality of iterations, the calculated, adapted charging potential nonetheless lies outside the defined working range, a charge image is generated in another development of the invention in that a photoconductor charged with minimum charging potential is illuminated with maximum illumination energy.

When, by contrast, the illumination energy calculated and adapted according to the method of the invention falls below the prescribed, minimum limit value, then the steps recited in patent claim 6 are preferably likewise implemented, whereby, however, the maximum illumination energy is employed instead of the minimum illumination energy.

The photoconductor is charged with the prescribed charging potential and subsequently illuminated with minimum illumination energy. An adapted charging potential is calculated with the assistance of the discharge potential that is thus generated and subsequently measured. When the adapted charging potential lies within the prescribed working range, the photoconductor is charged to the adapted charging potential, illuminated with minimum illumination energy and the discharge potential generated in this way is subsequently identified anew.

When the newly determined discharge potential lies within a prescribed tolerance range, then the charge image is generated with the assistance of the adapted charging potential and the minimum illumination energy.

When, however, the generated discharge potential does not lie in the prescribed tolerance range, the adapted charging potential is newly identified, and the above-explained steps are implemented anew. This iteration loop is repeated until the generated discharge potential lies within the prescribed tolerance range, and the charge image can be generated with the adapted charging potential and the minimum illumination energy or until the charging potential calculated at the beginning of the iteration loop does not lie within the working range. In the latter instance, the charge image is generated with the assistance of the maximum charging potential and the minimum illumination energy.

It is particularly advantageous in the inventive method that the influence of all influencing factors that influence the characteristic of the photoconductor is taken into consideration it is also advantageous given the inventive method that the temperature of the photoconductor need not be kept constant and, in this respect, the operating costs of the electrophotographic printer means are lower.

A further advantage of the inventive method is comprised therein that raster lines or fine lines are reproduced with constant quality even given different characteristics of photoconductors. The useful life of photoconductors is thereby extended since these can still be utilized and continue to be employed even given less beneficial characteristics curves caused by age.

Further, an acquisition of data and the implementation of the inventive methods occur automatically. Since the inventive method sequences very fast, a review of the critical parameters can preferably be implemented not only after a printer is switched on, after printing pausing or after the replacement of a photoconductor but also at suitable time intervals during printing operations.

The invention is also directed to an arrangement for optimizing a charge image generation and, in particular, for implementing the inventive method. The aforementioned technical effects also apply to an arrangement that is preferably integrated into a printer or copier.

BRIEF DESCRIPTION OF THE DRAWINGS

The invention is explained below with reference to the enclosed drawings. Shown therein are.

DETAILED DESCRIPTION OF THE PREFERRED EMBODIMENTS

Figure 1:
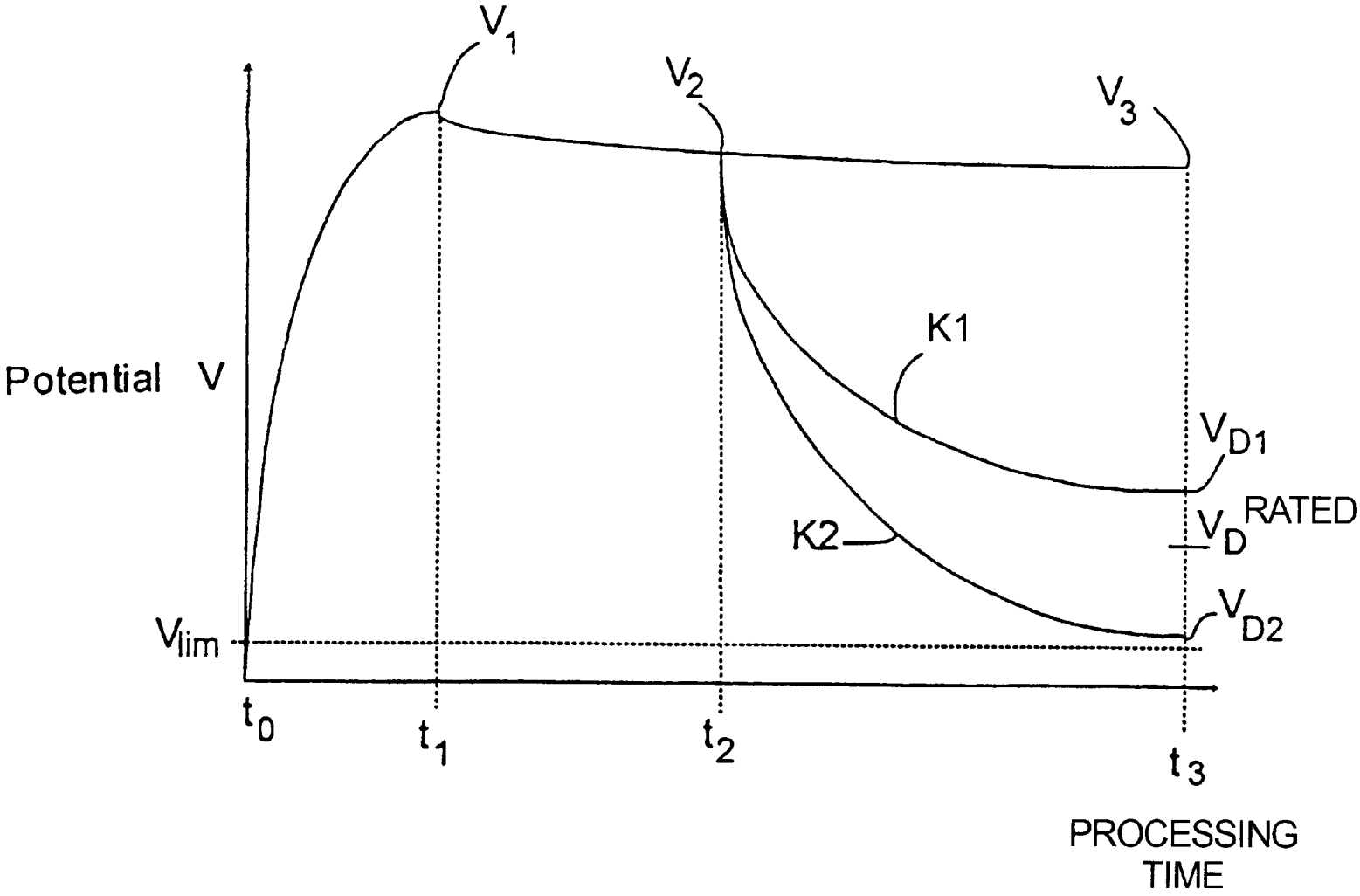
FIG. 1 a potential-time diagram of different characteristics of a photoconductor.

FIG. 1 shows a potential-time diagram of different characteristics K1, K2 of a photoconductor, whereby the potential V of the photoconductor is entered on an ordinate and the process time t is entered on the abscissa. A point in time $t_0$ thereby shows the beginning of the charging of a photoconductor to a potential $V_1$ that is reached at a point in time $t_1$. At a point in time $t_2$, the charge on the photoconductor can decrease to a potential $V_2$ due to environmental influences. The photoconductor is illuminated from the point in time $t_2$. As a result of the illumination, the potential present on the photoconductor decreases to a potential $V_{D1}$ or, respectively, $V_{D2}$ along a characteristic K1 or K2 in a time span from t2 through t3. The development of the charge image with toner in the development station begins at time $t_3$.

After the illumination, different discharge potentials $V_{D1}$ or, respectively, $V_{D2}$ are thus present on the photoconductor for the start of development at point in time $t_3$ after the illumination dependent on the characteristics K1 or K2. The characteristics K1 and K2 are a matter of exemplary characteristics, i.e. regions with different potentials deviating from $V_{D1}$ or $V_{D2}$ can also be present at point in time $t_3$ after the illumination.

The different curve of the characteristics K1 and K2 of one or more photoconductors is dependent, for example, on environmental conditions such as the temperature, on manufacture-conditioned fluctuations, on the quality of the photoconductor, on its age or on the current process status such as, for example, the beginning of the printing process or the poesition [sic] of a pause between individual printing events. The characteristic K1, for example, thereby describes a photoconductor that is relatively insensitive and/or cold. By contrast, the characteristic K2 describes a photoconductor that is more sensitive and/or warmer than the photoconductor described by the characteristic K1.

It can be seen from FIG. 1 that different residual or discharge potentials $V_{D1}$ or $V_{D2}$ remain on the photoconductor after the illumination dependent on the characteristics K1 or K2. Quality fluctuations in the print image occur due to these differences in potential between exposed regions. In the ideal case, by contrast, the potential after the illumination or, respectively, at point in time $t_3$ is at a value $V_D^{soll}$. A broken line shows the lowest obtainable discharge potential $V_{lim}$.

Figure 2A:
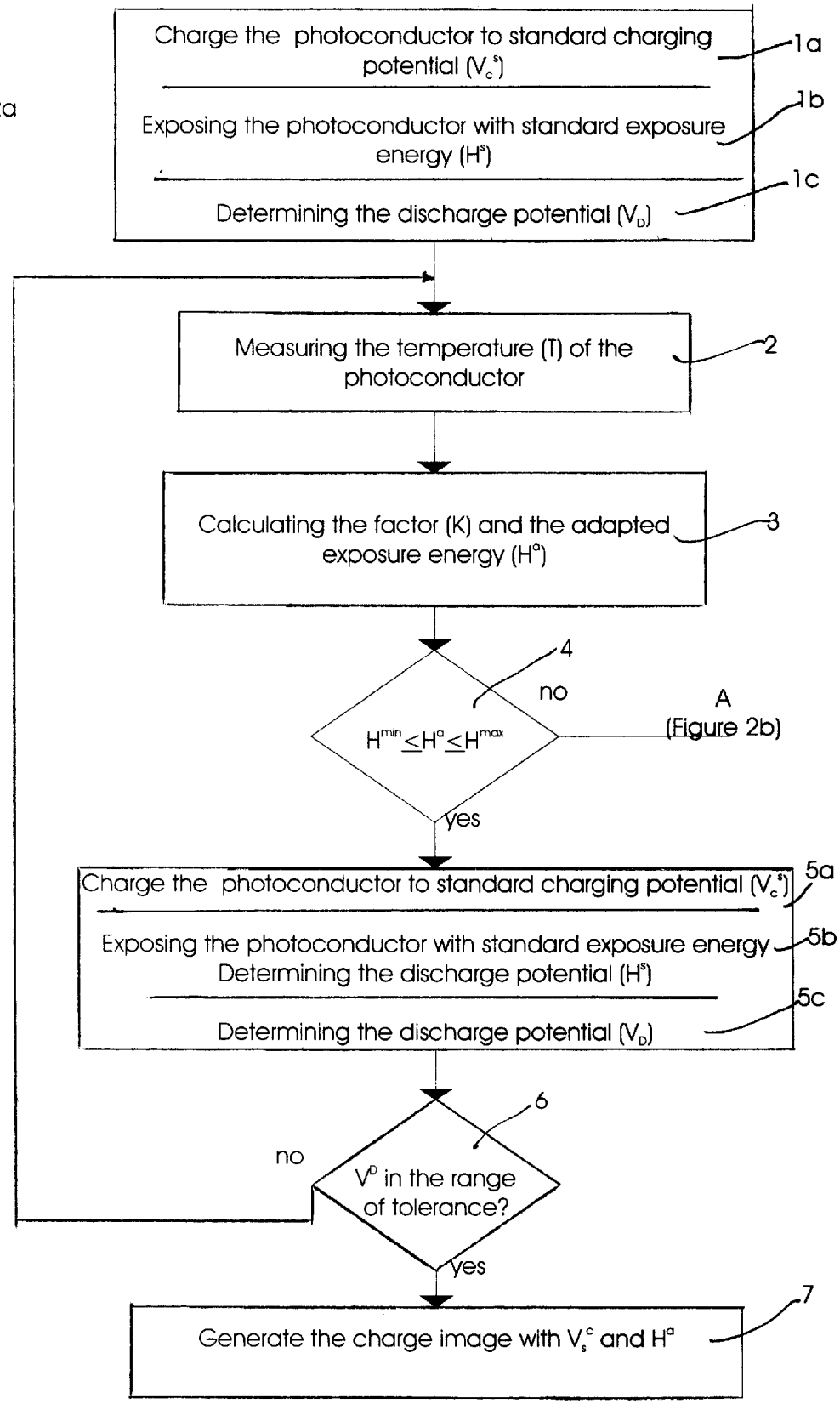
FIGS. 2*a*, 2*b* and 2*c* respective flowcharts of a preferred embodiment of the inventive method.
Figure 2B:
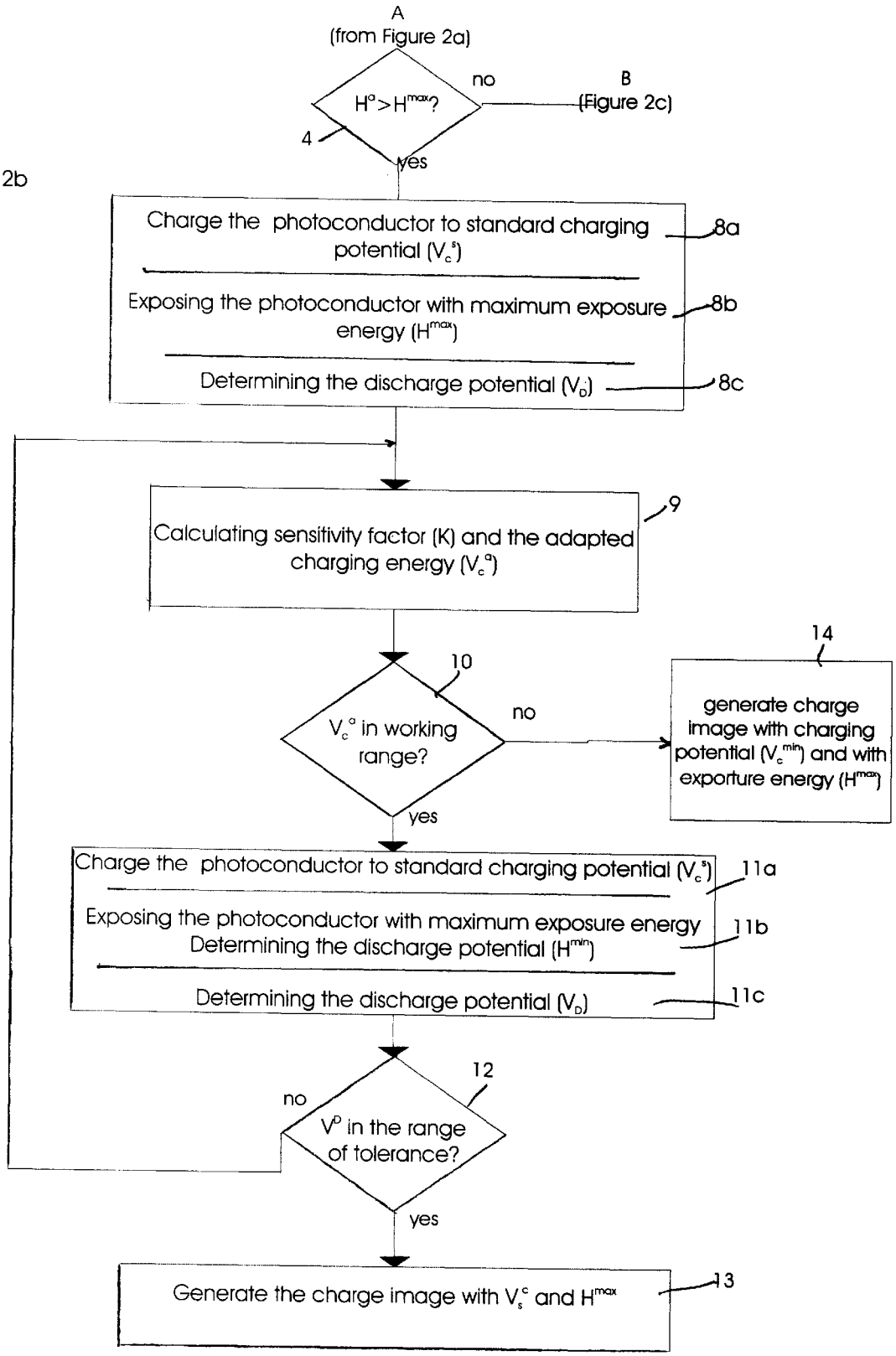
Figure 2C:
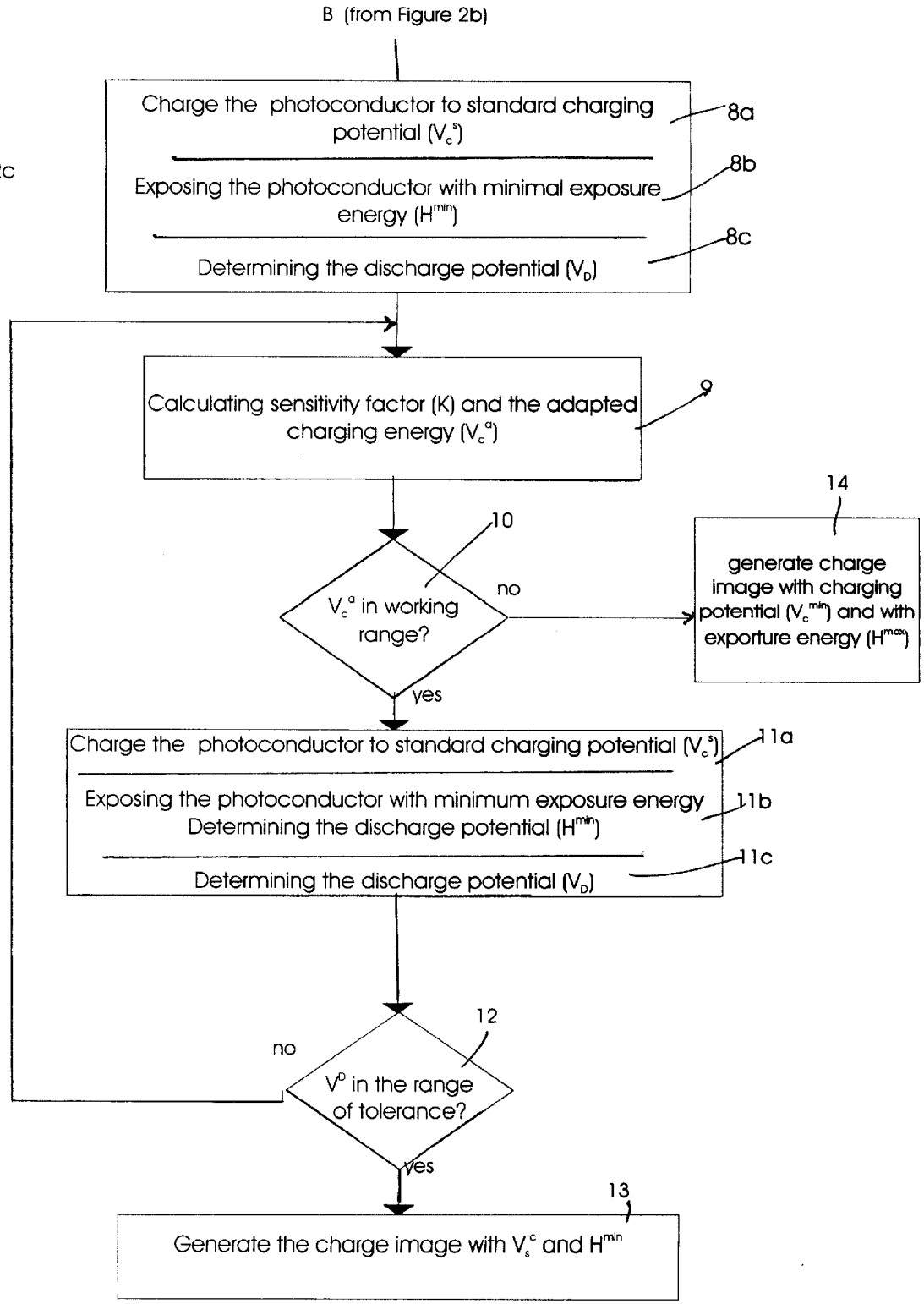

FIGS. 2*a* through 2*c* are flowcharts of a preferred implementation of the inventive method. According to FIG. 2*a*, charging (step 1*a*) after a printer means is turned on, after longer pauses or malfunctions of the photoconductors is carried out to the standard charging potential $V_C^s$ in V (Volts) that is kept constant with a known charging regulation.

The illumination is subsequently set to a standard illumination energy $H^s$ in $\mu Ws/cm^2$ and the photoconductor is illuminated $H^s$ [sic] (step 1*b*). When the illumination event has ended before or no later than point in time $t_3$ (see FIG. 1), the residual or, respectively, discharge potential $V_D$ is measured at point in time $t_3$ (step 1*c*). The discharge potential $V_D$ in V at point in time $t_3$ corresponds, for example, to one of the values $V_{D1}$ or $V_{D2}$ of a discharge potential that, dependent on the characteristic K1 or, respectively, K2 of a photoconductor, remains on the photoconductor as residual potential after the illumination (see FIG. 1).

Subsequently, the temperature T of the photoconductor is measured in step 2. The temperature, however, can also be measured at a later or an earlier point in time.

Subsequently, a sensitivity factor K is first calculated, and an adapted illumination energy $H^a$ in $\mu Ws/cm^2$ is calculated on the basis of the sensitivity factor K (step 3). Dependent, for example, on the momentary charging potential $V_C$, on the temperature T, the momentary illumination energy H, the measured discharge potential $V_D$ and the lowest obtainable discharge potential $V^{lim}$ [sic], the sensitivity factor K can be calculated with the assistance of Equation (1) as:

$$K = \frac{1}{TF \cdot H} \cdot \ln\left(\frac{V_c - V_{lim}}{V_D - V_{lim}}\right) \tag{1}$$

Instead of the temperature T, a temperature factor TF derived therefrom can also be employed, this more exactly indicating the influence of the temperature on the sensitivity factor K.

An adapted illumination energy $H^a$ is then calculated on the basis of the sensitivity factor K, preferably with the assistance of Equation (2):

$$H = \frac{1}{T \cdot K} \cdot \ln\left(\frac{V_C^s - V_{lim}}{V_D^{soll} - V_{lim}}\right) \tag{2}$$

whereby $V_D^{soll}$ is the target value for the discharge potential $V_D$.

In the following step 4, a check is carried out to see whether the illumination energy $H^a$ adapted in step 3 is lower than the maximum or higher than the minimum illumination energy $H^{max}$ or, respectively, $H^{min}$ that can be set with the employed or, respectively, existing illumination unit or is equal to one of these limit values. When $H^a$ lies outside this range, then the steps described later on the basis of FIGS. 2*b* and 2*c* are implemented.

When the adapted illumination energy $H^a$ lies in the interval $H^{min} \leqq H^a \leqq H^{max}$, then the photoconductor is again charged to the standard charging potential $V_C^s$ in a step 5 a analogous to the step 1*a*. After the end of the charging event, the photoconductor is illuminated with the calculated, adapted illumination energy $H^a$ (step 5*b*'). Subsequently, the discharge potential $V_D$ produced on the photoconductor is measured.

Thereafter, the discharge potential $V_D$ measured in step 5*c* is compared to the rated potential $V_D^{soll}$ in step 6 (see FIG. 1).

When the generated discharge potential $V_D$ lies within a predetermined tolerance range, i.e. when the generated discharge potential $V_D$ deviates only slightly from the rated potential $V_D^{soll}$, then a charge image is subsequently generated (step 7) in that the photoconductor is charged to the standard charging potential $V_C^s$ and is subsequently illuminated with the adapted illumination energy $H^a$.

When the discharge potential $V_D$ generated in step 5*c* does not lie within the predetermined tolerance range, then an iteration cycle is required with the discharge potential $V_D$ measured in step 5*c* and the adapted illumination energy $H^a$ calculated in step 3, whereby the steps 2 through 6 are implemented anew.

The above-described iteration loop in which the steps 2 through 6 are implemented is repeated until the generated discharge potential $V_D$ lies within the tolerance range and the step 7 can be implemented; i.e. a charge image is generated by charging the photoconductor to the standard charging potential $V_C^s$ and illumination with the correspondingly adapted illumination energy $H^a$.

When, however, the decision in step 4 is "no" in one of the iterations, the steps described below with reference to FIGS. 2*b* and 2*c* are implemented.

According to the part of the flowchart of the inventive method shown in FIG. 2*b*, a decision is made in a step 4' as to whether the adapted illumination energy $H^a$- calculated in step 3 (see FIG. 2*a*)- is higher than the maximally permitted illumination energy $H^{max}$. When the decision made in step 4' is "no", i.e. the adapted illumination energy is lower than a minimally permitted illumination energy $H^{min}$, then the part of the flowchart described later with reference to FIG. 2*c* is implemented.

When the adapted illumination energy $H^a$ is higher than the maximum illumination energy $H^{max}$, then the decision is "yes", and the photoconductor is charged to the standard charging potential $V_C^s$ in step 8*a* corresponding to step 1*a* and, differing from the steps 1*b* and 5*b*', is subsequently illuminated with maximum illumination energy $H^{max}$ (step 8*b*"). The discharge potential $V_D$ generated on the photoconductor is subsequently determined (step 8*c*).

An adapted charging potential $V_C^a$ is then determined in step 9; this, for example, can be calculated either according to Equation (3)

$$V_c^a=(V_D^{soll}-V_{lim})\cdot exp(K\cdot T\cdot H^{max})+V_{lim} \quad (3)$$

or according to Equation (4)

$$V_c^a(V_D, K, T, H) = \frac{V_D - V_{lim}}{1 - \exp(-K \cdot T \cdot H^{\max})} + V_{lim} \quad (4)$$

The momentary sensitivity factor K calculated on the basis of Equation (1) is employed in Equations (3) or (4).

A decision is made in step 10 as to whether the adapted charging potential $V_C^a$ lies within a working range or not.

When the decision in step 10 is "yes", the photoconductor is charged (step 11*a*') with the adapted charging potential $V_C^a$ calculated in step 9, is subsequently illuminated (step 11*b*') with maximum illumination energy $H^{max}$, and the discharge potential $V_D$ is identified in step 11*c*.

Whether the discharge potential $V_D$ lies within a predetermined tolerance range is subsequently investigated in step 12 analogous to step 6. When this is the case, then the charge image is generated with the adapted charging potential $V^C_a$ and by an exposure with maximum illumination energy $H^{max}$.

When, however, the decision at step 10 is already "no" at the first pass or after passing through one or more iteration loops (steps 9 through 12), then the photoconductor is charged with a minimum charging potential $V_C^{min}$ and is subsequently exposed with maximum illumination energy $H^{max}$.

The flowchart shown in FIG. 2*c* is implemented when the decision made in step 4' (FIG. 2*b*) is "no", i.e. the adapted illumination energy $H^a$ calculated in step 3 (FIG. 2*a*) is lower than the minimum illumination energy $H^{min}$.

As can be seen from FIG. 2*c*, the steps 8*a* through 13 already shown in FIG. 2*b* are implemented, with the exception of steps *b"', 9' 11*b*", 13' and 14' . Differing from step 8*b*", the photoconductor in FIG. 2*b* is not illuminated with maximum but with minimum illumination energy $H^{min}$ in step 8*b*"'. When the result of the decision in step 10 is "no" , then the step 14' , in which a charge image is generated with minimum illumination energy $H^{min}$ on the photoconductor charged to maximum charging potential $V_C^{max}$, is implemented in the part of the flowchart shown in FIG. 2*c*.

A further difference between the part shown in FIG. 2*b* after step 8*a* and the part shown in FIG. 2*c* is comprised in the Equation (3) employed in step 9' . Analogous to the above-described difference of the two parts in the steps 8*b*"', 11*b*", 13' and 14', wherein a minimum illumination energy $H^{min}$ is employed instead of a maximum, the Equation (3') wherein $H^{max}$is replaced by $H^{min}$ must be employed instead of the Equation (3) employed in step 9 for the calculation of the adapted charging potential $V_C^a$; Equation (3') therefore reads as follows:

$$_c^a=(V_D^{soll}-V_{lim})\cdot exp(K\cdot T\cdot H^{max})+V_{lim} \quad (3') \text{ [sic!!}$$

Since this is thereby an image generation with permanently prescribed values and not values determined with the inventive optimization method, a corresponding display can be activated in order to alert the user that the copier of printer device is not working under optimum operating conditions.

Although other modifications and changes may be suggested by those skilled in the art, it is the intention of the inventors to embody within the patent warranted hereon all changes and modifications as reasonably and properly come within the scope of their contribution to the art.

We claim:

1. A method for optimizing a charge image generation on a photoconductor of an electrophotographic printer or copier device, comprising the steps of:

a) charging the photoconductor to a predetermined charging potential;

b) illuminating the charged photoconductor with a predetermined illumination energy so that the photoconductor is thereby discharged;

c) determining a discharge potential of the illuminated photoconductor;

d) determining a temperature of the photoconductor;

e) determining a sensitivity factor from the charging potential, the illumination energy, the discharge potential and the temperature, said sensitivity factor defining the relationship between the discharge potential and the illumination energy in a predetermined relationship between the discharge potential and the illumination energy given a fixed temperature;

f) determining a new illumination energy that is employed instead of a previous illumination energy from the charging potential, the temperature, the identified sensitivity factor and a predetermined rated value for the discharge potential according to the given relationship converted to the illumination energy;

g) and generating a charge image with the determined illumination energy and the predetermined charging potential.

2. A method according to claim 1, wherein said step of determining said sensitivity factor is performed according to the equation $$K = \frac{1}{TF \cdot H} \cdot \ln\left(\frac{V_c - V_{lim}}{V_D - V_{lim}}\right)$$

whereby

K is the sensitivity factor,

TF is a temperature factor determined from the temperature T,

H is the illumination energy in $\mu$Ws/cm$^2$, $V_C$ is the charging potential in V, $V_D$ is the discharge potential in V, and $V_{lim}$ is the lowest obtainable discharge potential in V.

3. A method according to claim 1, wherein said step of determining said new illumination energy is performed according to the equation:

$$H = \frac{1}{T \cdot K} \cdot \ln\left(\frac{V_C^s - V_{lim}}{V_D^{soll} - V_{lim}}\right)$$

whereby

H is the illumination energy,

TF is a temperature factor determined from the temperature,

K is the sensitivity factor, $V_c$ is the charging potential in V, $V_D^{soll}$ is the rated value of the discharge potential in V, and $V_{lim}$ is the lowest obtainable discharge potential in V.

4. A method according to claim 1, further comprising the following steps following step f) of determining said new illumination energy according to claim 1:

f1) after the renewed illumination of the photoconductor charged with the predetermined charging potential with the most recently determined illumination energy, identifying anew the discharge potential on the photoconductor and employing the new discharge potential instead of the previous discharge potential;

f2) when the discharge potential lies within a predetermined tolerance range, implementing the step g) according to claim 1;

f3) when the discharge potential does not lie within the tolerance range, repeating the steps d) through f) or e) through f3) until the discharge potential lies within the tolerance range.

5. A method according to claim 1, wherein said rated value is a difference of the charging potential and the discharge potential.

6. A method for optimizing a charge image generation on a photoconductor of an electrophotographic printer or copier device, comprising the steps of:

A) charging the photoconductor to a predetermined charging potential;

B) illuminating the charged photoconductor with a predetermined illumination energy so that the photoconductor is discharged;

C) determining the discharge potential of the illuminated photoconductor;

D) determining the temperature of the photoconductor;

E) determining a sensitivity factor from the charging potential, the illumination energy, the discharge potential and the temperature, said sensitivity factor defining the relationship between the discharge potential and the illumination energy in a predetermined relationship between the discharge potential and the illumination energy given a fixed temperature;

F) determining a new charging potential that is employed instead of the previous charging potential from the illumination energy, the temperature, the identified sensitivity factor and a predetermined rated value for the discharge potential according to the given relationship converted to the charging potential;

G) and generating a charge image with the predetermined illumination energy and the determined charging potential.

7. A method according to claim 6, wherein said step of determining said sensitivity factor is performed according to the equation:

$$K = \frac{1}{TF \cdot H} \cdot \ln\left(\frac{V_c - V_{lim}}{V_D - V_{lim}}\right)$$

whereby

K is the sensitivity factor,

TF is a temperature factor determined from the temperature T,

H is the illumination energy in $\mu$Ws/cm$^2$, $V_C$ is the charging potential in V, $V_D$ is the discharge potential in V, and $V_{lim}$ is the lowest obtainable discharge potential in V.

8. A method according to claim 6, wherein said step of determining said new charging potential is performed according to the equation:

$$V_C=(V_D^{soll}-V_{lim})\cdot exp(K\cdot TF\cdot H)+V_{lim}$$

whereby $V_C$ is the charging potential, $V_D^{soll}$ is the discharge potential in V, $V_{lim}$ is the lowest obtainable discharge voltage in V;

TF is a temperature factor determined from the temperature T,

K is the sensitivity factor, and

H is the illumination energy in $\mu$Ws/cm$^2$.

9. A method according to claim 6, wherein said rated value is a difference of the charging potential and the discharge potential.

10. Method according to claim 6, further comprising the following steps following the step F) of determining a new charging potential:

F1) after the renewed illumination of the photoconductor charged with the determined charging potential with the predetermined illumination energy, identifying anew the discharge potential on the photoconductor and employing the new discharge potential;

F2) when the discharge potential lies within a predetermined tolerance range, implementing the step G) according to claim 6;

F3) when the discharge potential does not lie within the tolerance range, repeating the steps D) through F3) or E) through F3) until the discharge potential lies within the tolerance range.

11. A method according to claim 6, further comprising the steps of:

before the implementation of said steps, making a determination that an illumination energy determined for a prescribed charging potential lies above a maximum illumination energy;

and that the prescribed illumination energy has the value of the maximum illumination energy.

12. A method according to claim 11, further comprising the steps of:

before implementing of the step F1), carrying out a check to see whether the determined charging potential lies in a predetermined working range;

only implementing the step F1) when the determined charging potential lies within the working range;

and instead of the steps F1 through F3), generating a charge image with the predetermined illumination energy and with a predetermined charging potential that preferably lies at a limit of the working range when the identified charging potential lies outside the working range.

13. A method according to claim 6, further comprising the steps of:

before the implementation of said steps, making a determination that an illumination energy determined for a prescribed charging potential lies below a minimum illumination energy; and that the prescribed illumination energy has the value of the minimum illumination energy.

14. A method according to claim 6, wherein said step of determining the charging potential is performed according to the equation:

$$\Delta V_c = \frac{V_D - V_{lim}}{1 - \exp(-K \cdot TF \cdot H^{\max})} + V_{lim}$$

whereby $V_C$ is the charging potential in V, $V_D$ is the discharge potential in V, K is the sensitivity factor, TF is a temperature factor determined from the temperature T, H is the illumination energy in $\mu$Ws/cm$^2$, and $V_{lim}$ is the lowest obtainable discharge potential in V.

15. A method according to claim 6, wherein said step of determining said temperature factor is determined from the temperature according to the following equation:

$$TF = a + b \cdot T + c \cdot T^2,$$

whereby T is the temperature in degrees Celsius, and whereby a, b and c are fixed coefficients.

16. A method according to claim 6, further comprising the step of:

for accelerating implementation of the method, producing allocation tables proceeding from the predetermined relationship and/or the converted relationship.

17. A method according to claim 6, further comprising the step of: for accelerating implementation of the method, empirically producing printer specific allocation tables.

18. A method according to claim 6, further comprising the steps of:

implementing the method after turn-on, after printing pauses, after replacement of the photoconductor and/or at predetermined time intervals during printing operation.

19. An arrangement for optimizing a charge image generation, comprising:

a light-sensitive layer system, a charging mechanism for generating a charging potential on the light-sensitive layer system, an illumination means for the illumination of the charged layer system with an illumination energy, a temperature sensor for acquiring the temperature of the layer system, a potential sensor for acquiring the discharge potential on the light-sensitive layer system after the illumination, and a control unit for prescribing the charging potential and the illumination energy, in the prescription of the charging potential and/or of the illumination energy, the control unit determines a sensitivity factor that defines the relationship between the discharge potential and the illumination energy in a predetermined relationship between the discharge potential and the illumination energy given a fixed temperature.

20. A printer comprising:

an arrangement including:

a light-sensitive layer system, a charging mechanism for generating a charging potential on the light-sensitive layer system, an illumination means for the illumination of the charged layer system with an illumination energy a temperature sensor for acquiring the temperature of the layer system, a potential sensor for acquiring the discharge potential on the light-sensitive layer system after the illumination, and a control unit for prescribing the charging potential and the illumination energy, in the prescription of the charging potential and/or of the illumination energy, the control unit determines a sensitivity factor that defines the relationship between the discharge potential and the illumination energy in a predetermined relationship between the discharge potential and the illumination energy given a fixed temperature.

* * * * *